US009311933B2

(12) United States Patent
Young et al.

(10) Patent No.: US 9,311,933 B2
(45) Date of Patent: Apr. 12, 2016

(54) METHOD OF PROCESSING A VOICE SEGMENT AND HEARING AID

(71) Applicant: Kuo-Ping Yang, Taipei (TW)

(72) Inventors: Neo Bob Chih-Yung Young, Taipei (TW); Kuan-Li Chao, Taipei (TW); Vincent Shuang-Pung Liaw, Taipei (TW); Yun-Da Hsieh, Taipei (TW); Pao-Chuan Torng, Taipei (TW); Kuo-Ping Yang, Taipei (TW); Shu-Hua Guo, Taipei (TW)

(73) Assignee: UNLIMITER MFA CO., LTD, Eden Island (SC)

( * ) Notice: Subject to any disclaimer, the term of this patent is extended or adjusted under 35 U.S.C. 154(b) by 151 days.

(21) Appl. No.: 14/165,928

(22) Filed: Jan. 28, 2014

(65) Prior Publication Data

US 2014/0358530 A1 Dec. 4, 2014

(30) Foreign Application Priority Data

May 30, 2013 (TW) ..... 102119138 A

(51) Int. Cl.

| | |
|---|---|
| ***G10L 25/90*** | (2013.01) |
| ***G10L 21/0364*** | (2013.01) |
| *H04R 25/00* | (2006.01) |
| *G10L 25/93* | (2013.01) |

(52) U.S. Cl.

CPC ..... *G10L 25/90* (2013.01); *G10L 21/0364* (2013.01); *G10L 2025/937* (2013.01); *H04R 25/353* (2013.01)

(58) Field of Classification Search

CPC ..... H04R 25/353; H04R 2225/43; H04R 25/356; G10L 2021/065; G10L 2025/937

USPC ..... 381/316, 320; 704/207, 234, 233, 236, 704/253, 254, 260, 267

See application file for complete search history.

(56) References Cited

U.S. PATENT DOCUMENTS

| | | | | |
|---|---|---|---|---|
| 8,098,859 | B2 * | 1/2012 | Zeng et al. | 381/316 |
| 2008/0082327 | A1 * | 4/2008 | Murase et al. | 704/234 |
| 2012/0078625 | A1 * | 3/2012 | Stokes | 704/233 |
| 2012/0250915 | A1 * | 10/2012 | Takagi | H04R 25/353 381/312 |

* cited by examiner

*Primary Examiner* — Charlotte M Baker
(74) *Attorney, Agent, or Firm* — Bacon & Thomas, PLLC

(57) ABSTRACT

A method of processing a voice segment includes checking whether a voice segment is a vowel segment. If the voice segment is not a vowel segment, then the process checks whether the voice segment is a high frequency consonant or a low frequency consonant. If the voice segment is a high frequency consonant, then the voice segment will be processed to lower its frequency.

20 Claims, 6 Drawing Sheets

METHOD OF PROCESSING A VOICE SEGMENT AND HEARING AID

BACKGROUND OF THE INVENTION

1. Field of the Invention

The present invention relates to a method of processing speech, especially for hearing-impaired listeners or the elderly.

2. Description of the Related Art

It has been quite a long time since hearing aids were first developed. The main concept of the hearing aid is to amplify a sound so as to help a hearing-impaired listener to hear a previously-unheard sound, and to make the sound amplification process hardly generate a sound delay. Furthermore, if the hearing aid is focused on processing the frequency, generally it is to reduce the sound frequency. For example, U.S. Pat. No. 6,577,739 discloses an "Apparatus and methods for proportional audio compression and frequency shifting" to compress a sound signal according to a specific proportion for being provided to a hearing-impaired listener with hearing loss in a specific frequency range. However, this technique involves compressing the overall sound; even though it can perform real-time output, it can result in serious sound distortion.

U.S. Pat. No. 4,454,609 discloses a method of "Speech intelligibility enhancement" used for enhancing the consonant sounds of speech with high frequency. The greater the high frequency content relative to the low, the more such high frequency content is boosted. In this known prior art, consonant high frequency sounds are enhanced. However, it is very difficult to detect the occurrence of consonants in daily conversations. Therefore, this known prior art is not applicable to a hearing aid.

U.S. Patent Publication No. 2007/0127748 discloses a method of "Sound enhancement for hearing-impaired listeners" to process high frequency sound segments into low frequency sound segments. However, this known prior art neither discloses how to process the low frequency sound segments nor determines whether to divide the vowels and consonants for performing sound processing.

Therefore, there is a need to provide a method of processing a voice segment and a hearing aid capable of processing speech in real time and simplifying the calculations of the process, thereby enhancing the sound accuracy heard by a hearing-impaired listener to mitigate and/or obviate the aforementioned problems.

SUMMARY OF THE INVENTION

It is an object of the present invention to provide a method of and a hearing aid for enhancing the sound accuracy heard by a hearing-impaired listener.

To achieve the abovementioned object, the method of processing a voice segment of the present invention comprises the following steps:

The method checks whether a voice segment is a vowel segment; if the voice segment is not a vowel segment, then the method performs the following steps.

The method then checks whether the voice segment is a high frequency consonant or a low frequency consonant.

If the voice segment is a high frequency consonant, the method processes the voice segment to lower its frequency.

The method further performs an energy amplification process or a voice extending process on the consonant (either the high frequency consonant or the low frequency consonant).

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
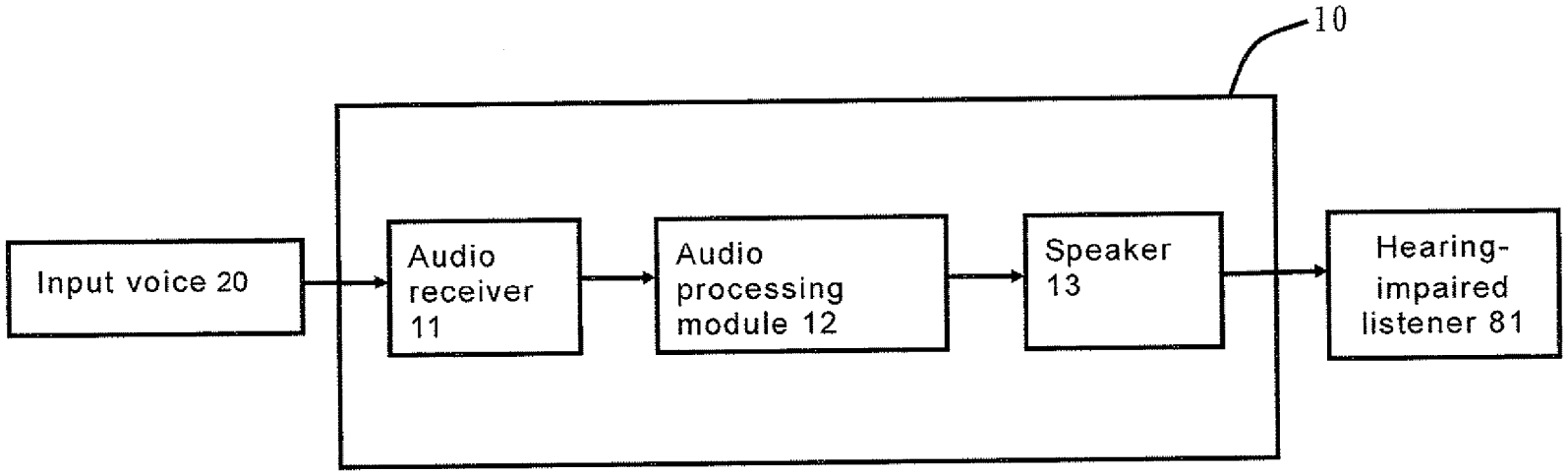
FIG. 1 illustrates a structural drawing of a hearing aid according to the present invention.

Please refer to FIG. 1, which illustrates a structural drawing of a hearing aid according to the present invention.

The hearing aid 10 of the present invention comprises an audio receiver 11, an audio processing module 12, and a speaker 13. The audio receiver 11 is used for receiving an input voice 20. The input voice 20 is processed by the audio processing module 12 for being outputted through the speaker 13 to a hearing-impaired listener 81. The audio receiver 11 can be a microphone or any other equivalent voice receiving equipment, and the speaker 13 (which can also include an amplifier) can be a headphone or any other equivalent voice outputting equipment, without being limited to the above scope. The audio processing module 12 is generally composed of a sound effect processing chip associated with a control circuit and an amplification circuit; alternatively, it can be composed of a solution including a processor and a memory associated with a control circuit and an amplification circuit. The purpose of the audio processing module 12 is to amplify voice signals, to filter out noises, to change the frequency composition of the voice, and to perform necessary processes according to the object of the present invention. Because the audio processing module 12 can be implemented by utilizing conventional hardware associated with new firmware or software, there is no need for further description of the hardware structure of the audio processing module 12. Basically, the hearing aid 10 of the present invention can be a hardware specialized dedicated device, or it can be, but is not limited to, a small computer such as a personal digital assistant (PDA), a PDA phone, a smart phone, and/or a personal computer.

Figure 2:
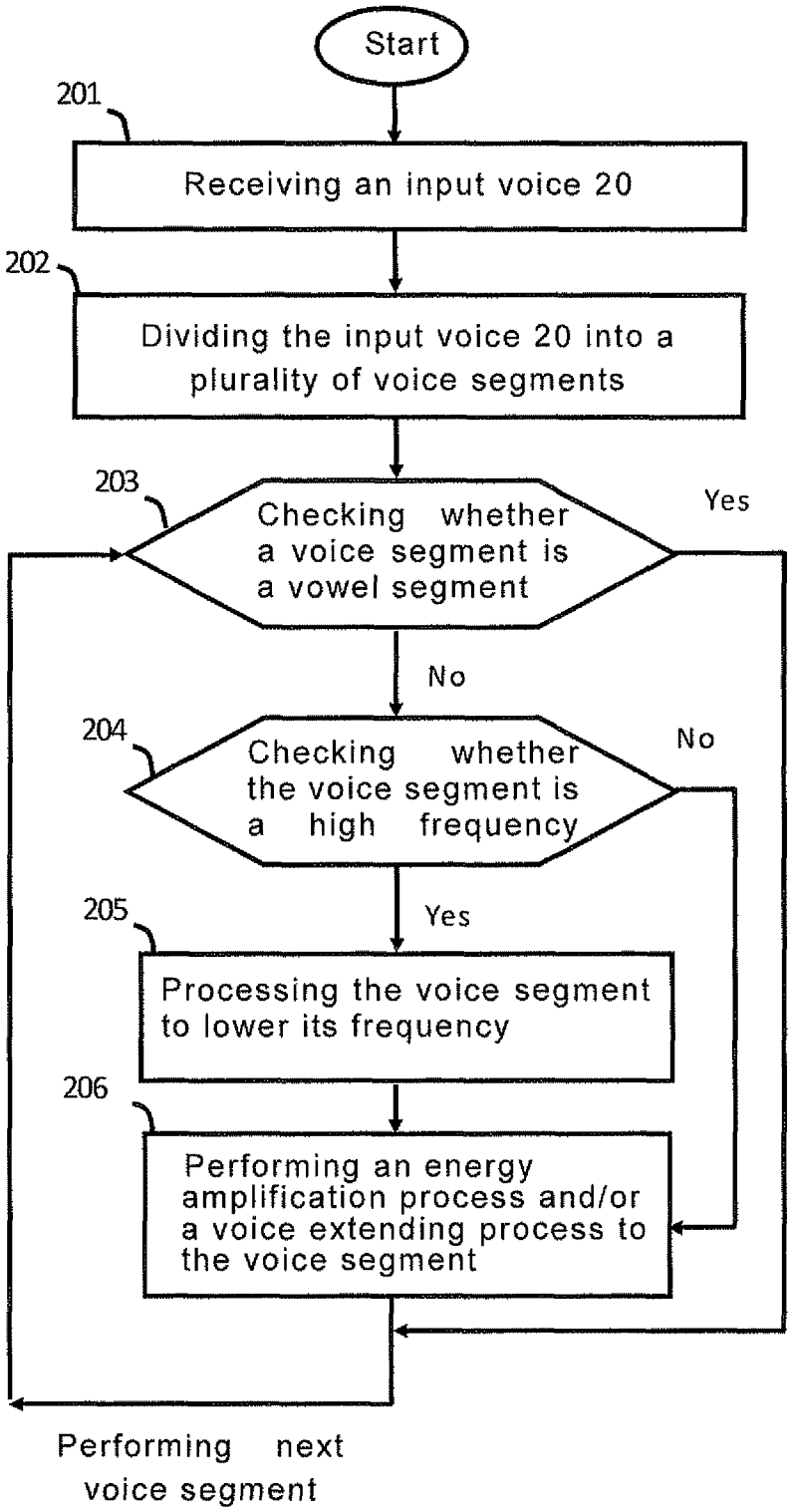
FIG. 2 illustrates a flowchart of an audio processing module according to the present invention.
Figure 3:
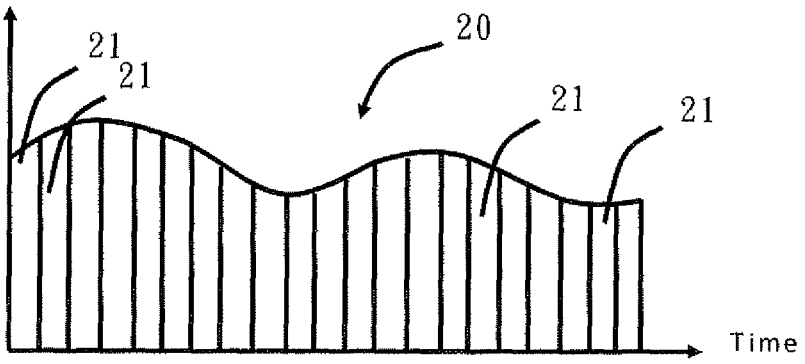
FIG. 3 illustrates a schematic drawing of dividing an input voice into a plurality of voice segments.

Please refer to FIG. 2, which illustrates a flowchart of an audio processing module according to the present invention. Please also refer to FIG. 3 to FIG. 9 for more details of the present invention.

Step 201: receiving an input voice 20, wherein this step is accomplished by the audio receiver 11.

Step 202: dividing the input voice 20 into a plurality of voice segments 21. The time length of each voice segment is preferably between 0.0001 and 0.1 second. According to an experiment utilizing an Apple™ iPhone4™ as the hearing aid device (by means of executing, on the Apple™ iPhone4™, a software program made according to the present invention), a positive outcome is obtained when the time length of each voice segment is between about 0.0001 and 0.1 second.

Step 203: checking whether a voice segment is a vowel segment. The present invention checks the plurality of voice segments sequentially. If the currently checked voice segment is a vowel segment, the invention will check the next voice segment. If the voice segment is not a vowel segment, then the invention performs step 204. Please refer to FIG. 4; the input voice 20*a* includes a low frequency consonant and a vowel. For example, "ㄆㄠ (Pao)" in Mandarin or "Pin" in English has a preceding consonant segment and a following vowel segment. The mesh dots shown in FIG. 4 represent the energy at a certain frequency, wherein more intensive dots represent a higher energy, and the line portion means the energy is concentrated at a certain frequency.

When the invention checks the voice segment 21*a*, then if the voice segment 21*a* is not a vowel segment, the invention performs step 204. When the invention checks the voice segment 21*b*, because the voice segment 21*b* is a vowel segment, the invention does nothing and then checks the next voice segment.

Figure 4:
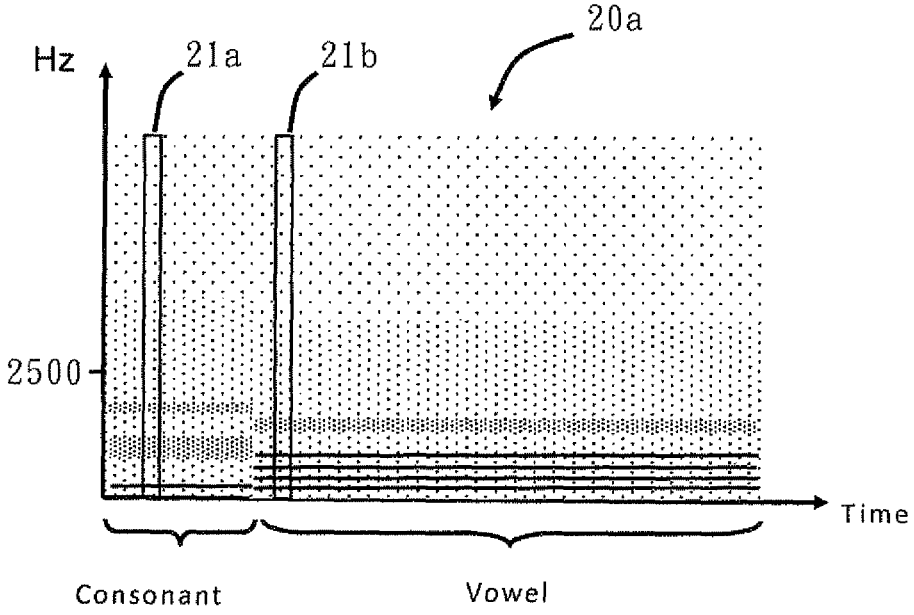
FIG. 4 illustrates a frequency diagram of an input voice having a low frequency consonant and a vowel.
Figure 5:
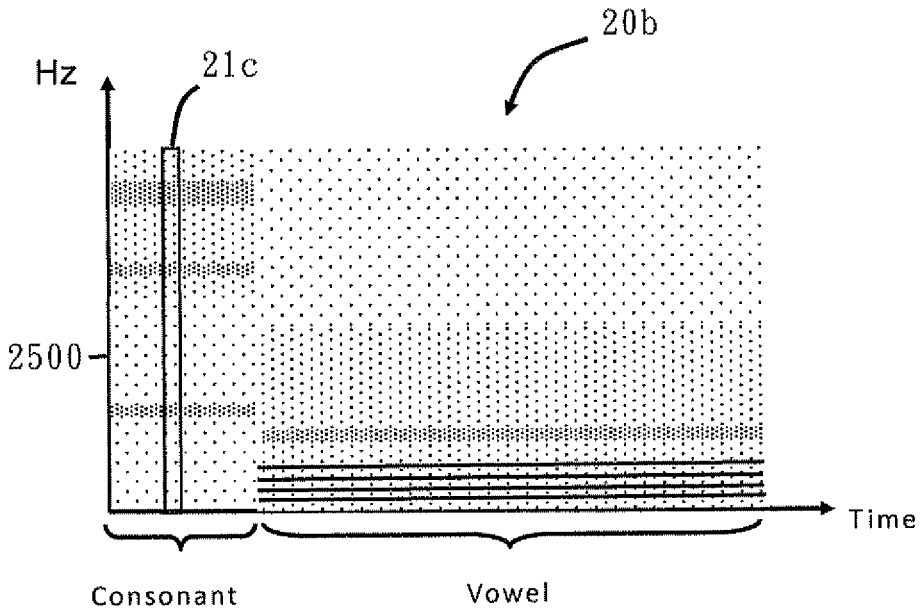
FIG. 5 illustrates a frequency diagram of an input voice having a high frequency consonant and a vowel.
Figure 6:
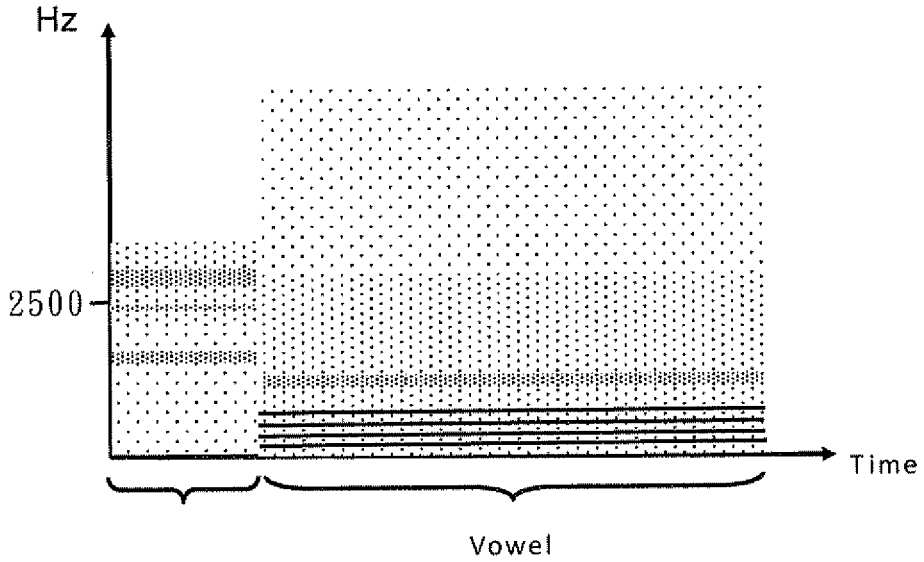
FIG. 6 illustrates a schematic drawing of processing a high frequency consonant to lower its frequency according to the present invention.

Regarding the process of determining whether the voice segment is a vowel segment, please refer to the vowel as shown in FIG. 4 for more details. A vowel generally includes 2 to 100 sections of harmonic phenomena (which may vary depending on the vowel itself, and the tones of different pronunciations), and the energy is concentrated in the frequency of the 2 to 100 sections. Because the characteristics of the vowel are well known, there is no need for further description.

Step 204: checking whether the voice segment is a high frequency consonant. If the voice segment is a high frequency consonant, the invention performs step 205; if the voice segment is not a high frequency consonant, the invention performs step 206. Please note that step 204 can be altered to "checking whether the voice segment is a low frequency consonant" associated with an opposite determination.

The goal of checking whether a voice segment is a high frequency consonant is to check whether the energy of the consonant is distributed in a high frequency region. There are many ways of determining whether a voice segment is a high frequency consonant or a low frequency consonant. For example, if at least 50% of the total energy of a certain voice segment is over 2500 Hz, it is determined to be a high frequency consonant.

For example, because less than 50% of the total energy of the voice segment 21*a* is over 2500 Hz, it will not be determined to be a high frequency consonant. Please refer to FIG. 5; the input voice 20*b* includes a high frequency consonant and a vowel, such as "ㄗㄠ (Zao)" in Mandarin or "See" in English, wherein more than 50% of the total energy of the voice segment 21*c* is over 2500 Hz; therefore, it is determined to be a high frequency consonant.

Step 205: processing the voice segment to lower its frequency. Generally, the process of lowering the frequency includes a frequency compression process or a frequency shifting process, or both. Preferably, the invention performs the frequency compression process on a high frequency section (such as a range of 4,000 Hz to 10,000 Hz), and then performs the frequency shifting process. Take the voice segment 21*c* as an example; the invention performs the frequency compression process on the range of 4,000 Hz to 10,000 Hz of the voice segment 21*c* so as to compress the frequency to 5,000~4,000 Hz; then the invention down-shifts 1,000 Hz of the 5,000~4,000 Hz frequency range. In this embodiment, the invention does nothing to the range of 0~4,000 Hz.

Figure 7:
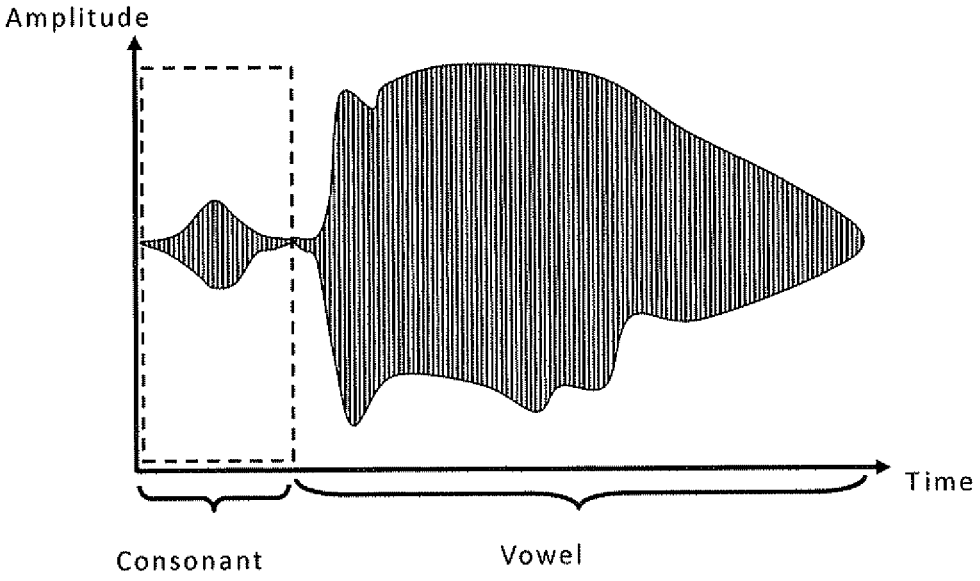
FIG. 7 illustrates an amplitude diagram of an input voice having consonants and vowels.
Figure 8:
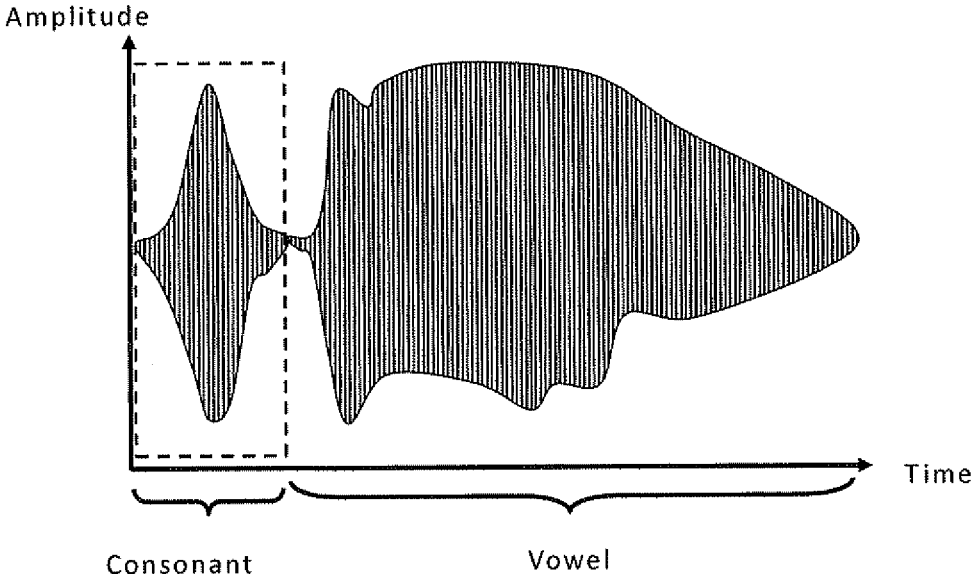
FIG. 8 illustrates a schematic drawing of amplifying the energy of a consonant voice segment according to the present invention.

Step 206: performing an energy amplification process or a voice extending process on the voice segment. The consonant is often characterized in a short syllable, which is very common in Mandarin pronunciation; therefore, the invention can perform an energy amplification process on the high frequency consonant or the low frequency consonant. The energy of a consonant, as shown in FIG. 7, will be amplified, as shown in FIG. 8, after passing through the energy amplification process, such that the hearing-impaired listener can hear the consonant more clearly. Please note that in step 206, the process of amplifying the energy of the consonant does not mean to exclude the process of amplifying the energy of the vowel segment. Normally, what the hearing-impaired listener needs is a louder sound volume, such as three times louder. What step 206 does is to amplify the energy of the consonant first, especially when the energy of the consonant is comparatively low (such as those of "ㄈ" and "ㄏ" in Mandarin or "F" and "H" in English), and then it amplifies it to three times its original volume directly through the speaker 13. Therefore, the amplifications of some consonants are higher than that of the vowel. Furthermore, the energy amplification process does not need to be applied to all consonants. In Mandarin, for example, high frequency consonants (many of which are aspirates) need the energy amplification process more than low frequency consonants do. Therefore, high frequency consonants need to be processed by step 206 more than low frequency consonants do. Moreover, step 206 can be skipped for listeners with mild hearing impairment.

Figure 9:
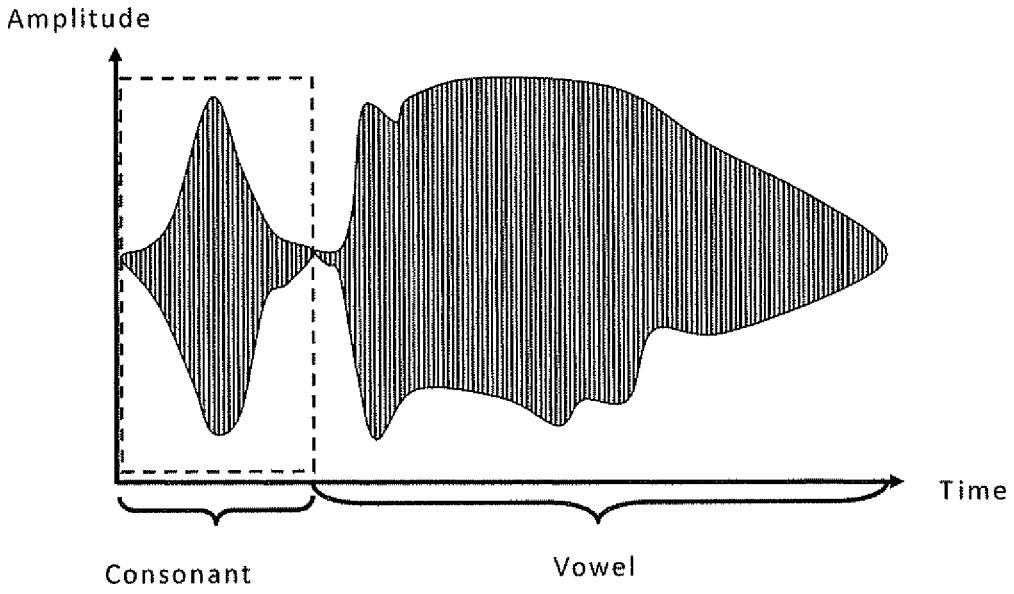
FIG. 9 illustrates a schematic drawing of extending the time of a consonant voice segment according to the present invention.

In addition to performing the energy amplification process on the consonant voice segment, the invention can also perform a voice extending process on the voice segment, such as a short consonant "ㄊ" in Mandarin or "T" in English, especially for listeners with severe hearing impairment. In step 206, the invention can do the following: only perform the voice extending process on the consonant voice segment without performing the energy amplification process; perform the energy amplification process only; or perform both the energy amplification process and the voice extending process (as shown in FIG. 9). If the voice extending process is applied to the consonant voice segment, it will probably result in a voice delay to the hearing aid that requires real-time voice processing, and thus a compensation process will be required. Please note that the compensation technique is not the key element of the present invention; please refer to U.S. patent application Ser. No. 13/833,009, which is also filed by the Applicant, for more details about the compensation technique.

Although the present invention has been explained in relation to its preferred embodiments, it is to be understood that many other possible modifications and variations can be made without departing from the spirit and scope of the invention as hereinafter claimed.

What is claimed is:

1. A method of processing a voice segment in a hearing aid comprising an audio receiver and an audio processing module, comprising:

receiving in said hearing aid an input voice, and dividing said input at least one voice segment;

in said audio processing module, checking whether said voice segment is a vowel segment;

if the voice segment is not a vowel segment:

checking whether the voice segment is a high frequency consonant or a low frequency consonant; and if the voice segment is a high frequency consonant, processing the voice segment to lower its frequency.

2. The method of processing a voice segment as claimed in claim 1, wherein the process of lowering the frequency comprises a frequency compression process or a frequency shifting process.

3. The method of processing a voice segment as claimed in claim 2, wherein the process of lowering the frequency comprises performing the frequency compression process and the frequency shifting process on a high frequency section of the voice segment.

4. The method of processing a voice segment as claimed in claim 3, wherein the high frequency section includes a range of at least 4,000 Hz to 10,000 Hz.

5. The method of processing a voice segment as claimed in claim 4, wherein the voice segment is determined to be a high frequency consonant if at least 50% of the total energy the voice segment is over 2,500 Hz.

6. The method of processing a voice segment as claimed in claim 5, wherein the step of checking whether the voice segment is a vowel segment includes checking whether the voice segment has a harmonic phenomenon.

7. The method of processing a voice segment as claimed in claim 6, wherein if the voice segment is a high frequency consonant, the method further comprises performing an energy amplification process or a voice extending process on the voice segment.

8. The method of processing a voice segment as claimed in claim 7, wherein if the voice segment is a low frequency consonant, the method further comprises performing an energy amplification process or a voice extending process on the voice segment.

9. The method of processing a voice segment as claimed in claim 2, wherein if the voice segment is a high frequency consonant, the method further comprises performing an energy amplification process or a voice extending process on the voice segment.

10. The method of processing a voice segment as claimed in claim 9, wherein if the voice segment is a low frequency consonant, the method further comprises performing an energy amplification process or a voice extending process on the voice segment.

11. A hearing aid, comprising:

an audio receiver, configured to receive an input voice;

an audio processing module, electrically connected to the audio receiver; and a speaker;

wherein the audio processing module is configured to divide the input voice into a plurality of voice segments; check whether each voice segment is a vowel segment; if the voice segment is not a vowel segment, check whether the voice segment is a high frequency consonant or a low frequency consonant, and if the voice segment is a high frequency consonant, processing the voice segment to lower its frequency; and the speaker is arranged to output the plurality of processed or unprocessed voice segments.

12. The hearing aid as claimed in claim 11, wherein the process of lowering the frequency comprises a frequency compression process or a frequency shifting process.

13. The hearing aid as claimed in claim 12, wherein the process of lowering the frequency comprises performing the frequency compression process and the frequency shifting process on a high frequency section of the voice segment.

14. The hearing aid as claimed in claim 13, wherein the high frequency section includes a range of at least 4,000 Hz to 10,000 Hz.

15. The hearing aid as claimed in claim 14, wherein the voice segment is determined to be a high frequency consonant if at least 50% of the total energy of the voice segment is over 2,500 Hz.

16. The hearing aid as claimed in claim 15, wherein the process of checking whether the voice segment is a vowel segment includes checking whether the voice segment has a harmonic phenomenon.

17. The hearing aid as claimed in claim 16, wherein if the voice segment is a high frequency consonant, the hearing aid further performs an energy amplification process or a voice extending process on the voice segment.

18. The hearing aid as claimed in claim 17, wherein if the voice segment is a low frequency consonant, the hearing aid further performs an energy amplification process or a voice extending process on the voice segment.

19. The hearing aid as claimed in claim 12, wherein if the voice segment is a high frequency consonant, the hearing aid further performs an energy amplification process or a voice extending process on the voice segment.

20. The hearing aid as claimed in claim 19, wherein if the voice segment is a low frequency consonant, the hearing aid further performs an energy amplification process or a voice extending process on the voice segment.

* * * * *